US008739348B1

(12) United States Patent
Currier

(10) Patent No.: US 8,739,348 B1
(45) Date of Patent: Jun. 3, 2014

(54) BROOM WITH CURVED OR ANGLED HEAD

(71) Applicant: Gordon Martin Currier, Ardmore, OK (US)

(72) Inventor: Gordon Martin Currier, Ardmore, OK (US)

( * ) Notice: Subject to any disclaimer, the term of this patent is extended or adjusted under 35 U.S.C. 154(b) by 0 days.

(21) Appl. No.: 13/717,190

(22) Filed: Dec. 17, 2012

(51) Int. Cl.
*A46B 15/00* (2006.01)

(52) U.S. Cl.
USPC ..... 15/159.1; 15/171

(58) Field of Classification Search
USPC ..... 15/159.1, 160, 171
See application file for complete search history.

(56) References Cited

U.S. PATENT DOCUMENTS

| | | | | | |
|---|---|---|---|---|---|
| 2,268,519 | A | * | 12/1941 | Teager | 15/78 |
| 3,134,129 | A | * | 5/1964 | Allen | 401/138 |
| 4,385,411 | A | | 5/1983 | Clark | |
| D321,793 | S | | 11/1991 | Bryant | |
| 5,117,530 | A | * | 6/1992 | Rank | 15/245 |
| 5,702,195 | A | * | 12/1997 | Rittenbaum | 401/289 |
| 6,199,241 | B1 | * | 3/2001 | Anumah | 15/160 |
| 7,000,281 | B1 | | 2/2006 | Morad | |

* cited by examiner

*Primary Examiner* — Randall Chin
(74) *Attorney, Agent, or Firm* — Harvey Law; Derrick W Harvey

(57) ABSTRACT

The present invention relates to brooms, including dust mops and brushes, and in particular to push brooms and handheld whiskbrooms. The invention relates to a broom head frame having a left section, center section and right section where the left section and right section are at an angle to the center sections. The left and right sections can be adjustable.

10 Claims, 7 Drawing Sheets

BROOM WITH CURVED OR ANGLED HEAD

BACKGROUND OF THE INVENTION

1. Field of the Invention

The present invention relates to the field of brooms, including dust mops and brushes, and in particular to push brooms, handheld whiskbrooms and straight brooms.

2. Description of Related Art

Brooms in general are old and well known in the art. Push brooms are known and handheld whiskbrooms are known. However, while known and commonly used, there is a continuing need to develop brooms that handle sweeping dust and debris in a better, more efficient manner.

SUMMARY OF THE INVENTION

In one embodiment of the invention there is provided a broom comprising a broom head frame. The frame has a front edge terminating in a front left end and a front right end. The frame having a left section, a right section and a center section with a left portion of the front edge forming a part of said left section, a center portion of the front edge forming a part of the center section and a right portion of the front edge forming a part of the right section. The front edge having a front apogee point between the front left end and the front right end, and a front apogee tangent line. The front edge having a concave shape such that the left portion and the right portion each extend ahead of the front apogee tangent line by from 10 degrees to 60 degrees. The length from the front left end to the front right end defining a frame length.

In another embodiment of the invention there is provided a broom comprising a broom head frame having a straight center section, a straight left section and a straight right section. The straight center section has a first end and a second end. The straight left section has a left end forming the left end of the frame and a right end mounted to the first end so as to be rotationally adjustable. The straight right section having a right end forming the right end of the frame and a left end mounted to the second end so as to be rotationally adjustable.

BRIEF DESCRIPTION OF THE DRAWINGS

FIG. 6 is a top view of an adjustable push broom in accordance with a further embodiment of the current invention.

DESCRIPTION OF THE PREFERRED EMBODIMENTS

The current invention concerns a sweeping broom or dust mop with a head that has an angled or curved concave design, but fabricated with a straight center or slightly curved section, and two forward-angled or curved end sections. The end sections are angled or curved at from 10 degrees to 60 degrees from the center section line or from an apogee tangent line as described below. This angle can be pre-formed in a fixed position, or it can be adjustable. The length of the center section can vary, as can the length of the end sections. The broom handle attaches to the broom head at the center or slightly offset to the center, or can protrude from the side, as in a counter top brush.

Figure 1:
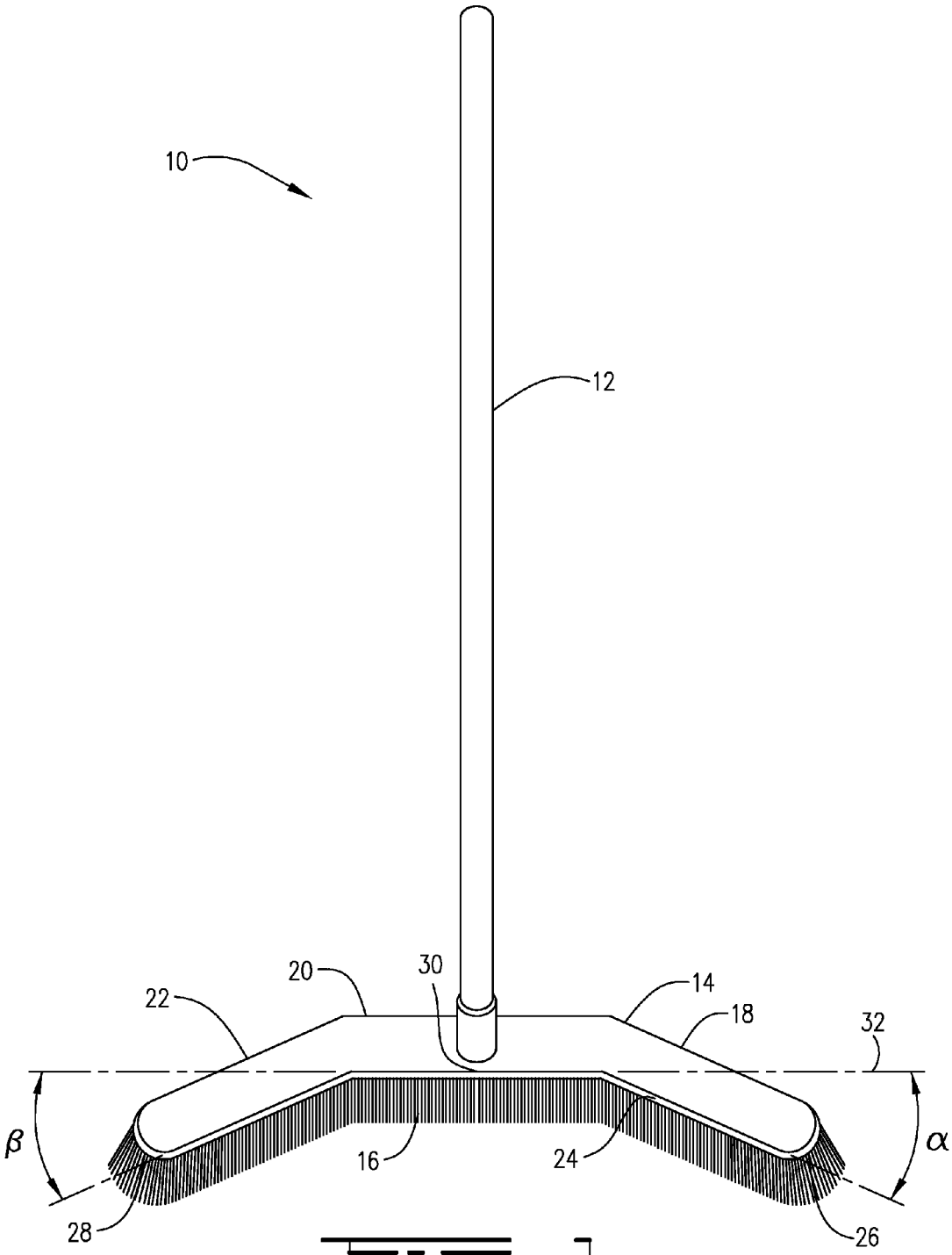
FIG. 1 is a front elevation view of a push broom in accordance with one embodiment of the current invention.
Figure 2:
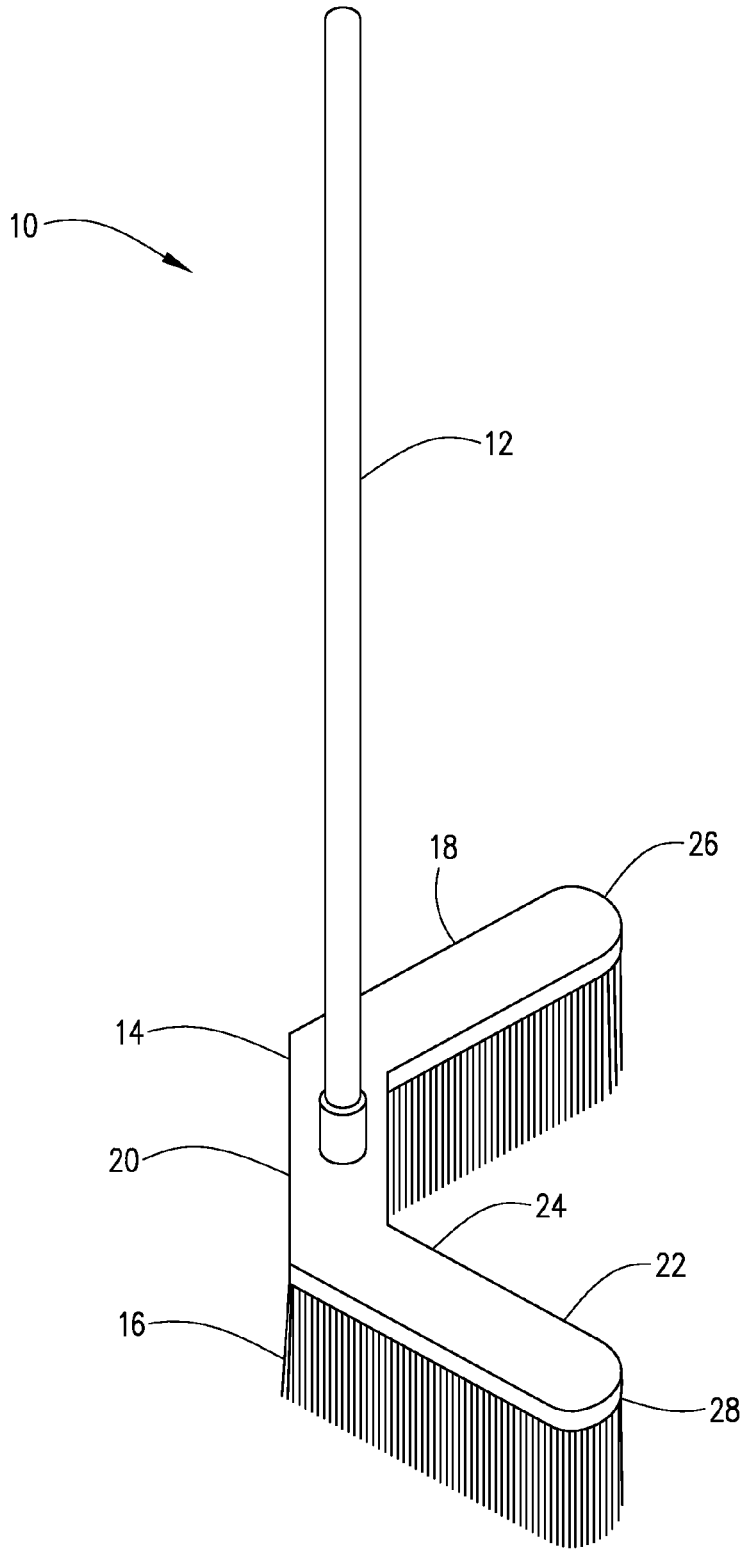
FIG. 2 is a side elevation view of a push broom in accordance with the embodiment illustrated in FIG. 1.
Figure 7:
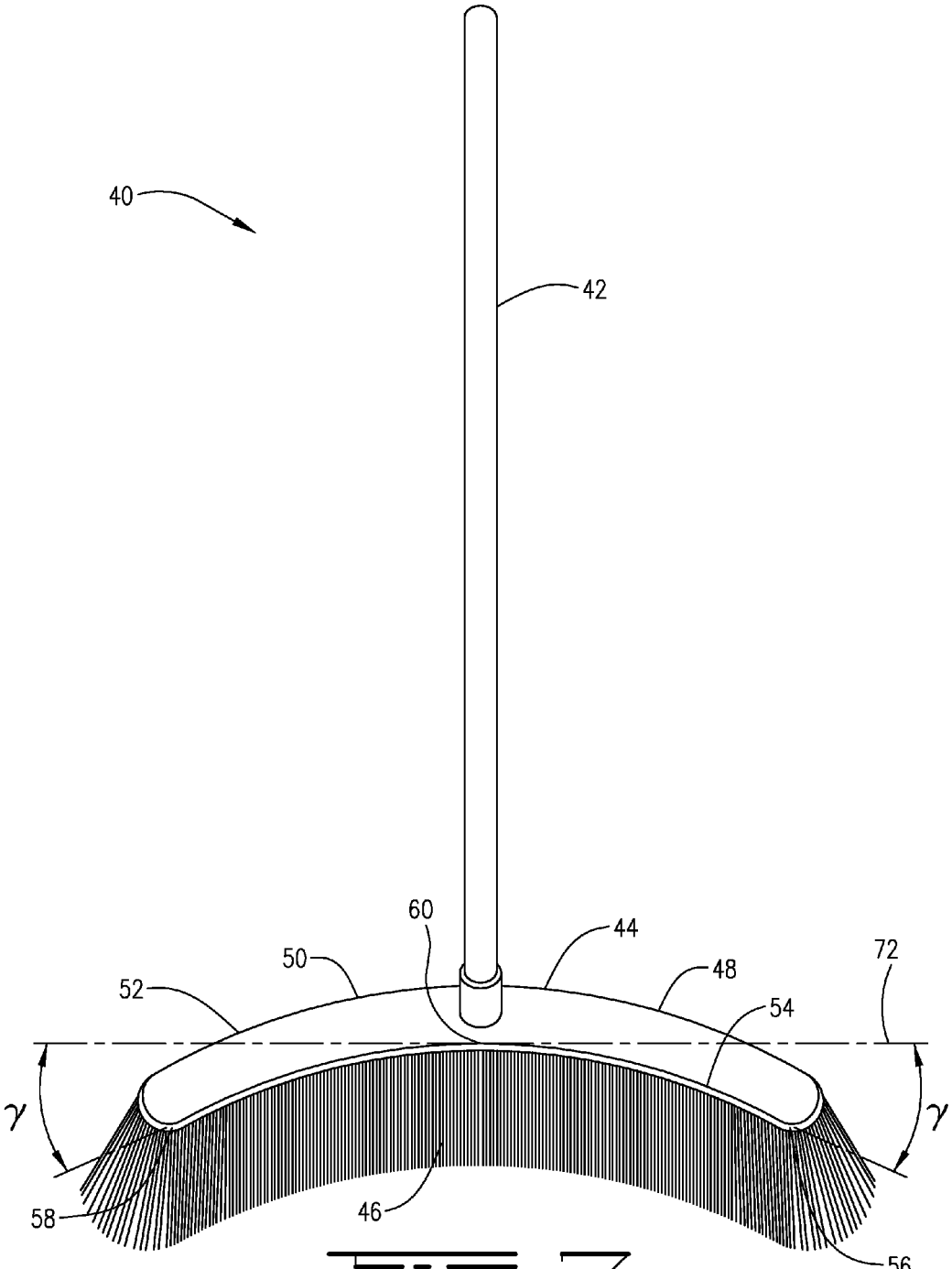
FIG. 7 is a front view of a curved frame broom with extended bristles in accordance with yet a further embodiment of the current invention.

Referring now to FIGS. 1 and 2 a push broom 10 in accordance with the current invention can be seen. Push broom 10 comprises handle 12, head or head frame 14 and bristles 16. Handle 12 is connected to the head frame 14. The connection can be by any conventional known means, such as by screw mounting or by the handle 12 being formed integrally with the head frame 14. The bristles 16 are attached to the head frame in known conventional means for such push brooms. The frame 14 comprises a left section 18, a center section 20 and a right section 22. As illustrated in FIG. 1, the left section 18, center section 20 and right section 22 are integrally connected. At this point, it should be noted that herein the embodiments will be described with reference from the position of a user during normal broom operation and, thus, terms such as left, right, front and back are to be interpreted from that perspective. Additionally, the angling of the frame will be described with reference to an apogee point and an apogee tangent line. For a straight center section such as shown in FIG. 1, the apogee point can lie longitudinally anywhere along the center section 20 and the apogee tangent line will be a parallel to the longitudinal axis of the center section 20. For a curved frame such as shown in FIG. 7, the apogee point will be the point along a curved front edge 54 of head frame 44 farthest from both the ends (56 and 58) of head frame 44 and the apogee tangent line 72 will be a line tangent to that front curved edge of head frame 44 at the apogee point. Laterally, the apogee point can lie any where along the width of the frame. Common choices would include choosing the apogee point at the front edge, back edge or center of the frame. The apogee points can be better understood with reference to the descriptions of FIG. 1 and FIG. 7 below.

Returning now to FIGS. 1 and 2, the head frame 14 has front edge 24. Front edge 24 terminates in front left end 26 and front right end 28. Front edge 24 extends across left section 18, center section 20 and right section 22 such that a left portion of the front edge 24 extends across left section 18, a center portion of front edge 24 extends across center section 20 and a right portion of front edge 24 extends across right section 22. As mentioned above, front edge 24 has front apogee point 30, which can be anywhere along the center portion of front edge 24. Front apogee tangent line 32 is parallel to the portion of front edge 24 at center section 20 and passes through the front apogee point 30. The end sections (left sections 18 and right sections 22 will be angled such that they extend ahead of the front apogee tangent line 32 and, thus, the frame will have a concave configuration. As illustrated, the left portion of front edge 24 is at an angle $\alpha$ to the front apogee tangent line 32 and the right portion of front edge 24 is at an angle $\beta$ to the front apogee tangent line 32. Generally, angles $\alpha$ and $\beta$ will be equal but it is within the scope of the invention for them to be different. Angles $\alpha$ and $\beta$ can be from 10 degrees and 60 degrees, can be from 20 degrees to 40 degrees or can be from 22 degrees to 30 degrees.

For purposes of this disclosure, the frame length is defined as the length from the front left end 26 to the front right end 28. The length of the center section 20 can vary, as can the length of the end sections. Generally, the center section 20 will comprise from 40 percent to 60 percent of the frame length and the left section 18 and the right section 22 will each comprise from 20 percent to 30 percent of the frame length. Often the center section 20 will comprise about 50 percent of the frame length and the left section 18 and the right section 22 will each comprise about 25 percent of the frame length.

The bristles 16 are positioned downward on the center section, and can be directed slightly inward on the end sections to help facilitate the debris being directed towards the center of the broom head. The bristles 16 are flared outward on each end (front left end 26 and front right end 28) of the frame to facilitate entry into confined spaces. These end bristles can generally be slightly longer than the other bristles to ensure contact with the floor. The amount of flaring of these end bristles depends on the type of broom and the length of the bristles. For typical push broom bristle lengths, the end bristles will generally flare outward from 0.5 inch to 3 inches from each end of the frame and can flare outward about 1 to about 2 inches. For example, if the bristles for the push broom are 3.5 inches then the end bristles can flare out about 1.5 inches from each end of the frame and the end bristles will be about a quarter of an inch longer than the non-end bristles.

Referring now to FIG. 7, the design can also feature a semi-circular head, where the center section is slightly concave, and the end sections continue this curvature. This could be in a gradual curve or various degrees. In the embodiment of FIG. 7, a straight broom 40 is illustrated; however, the discussion is applicable to other types of brooms. Straight broom 40 has a handle 42, head or head frame 44 and bristles 46. Handle 42 is connected to the head frame 44. The connection can be by any conventional known means, such as by screw mounting or by the handle being formed integrally with the head frame. The bristles are attached to the head frame in known conventional means for such straight brooms. The head frame 44 comprises a left section 48, a center section 50 and a right section 52, which make a continuous curve.

Returning now to FIG. 7, the head frame 44 has front edge 54. Front edge 54 terminates in front left end 56 and front right end 58. Front edge 54 extends across left section 48, center section 50 and right section 52 such that a left portion of the front edge 54 extends across left section 48, a center portion of front edge 54 extends across center section 50 and a right portion of front edge 54 extends across right section 52. Front edge 54 has front apogee point 60, which as mentioned above, is the point on front edge 54 farthest from both front left end 56 and front right end 58. In the embodiment illustrated, the front apogee point 60 is in the middle of front edge 54; however, for asymmetrical brooms this may not be the case. Front apogee tangent line 62 is tangent to the curve of front edge 54 and passes through the front apogee point 60. End sections (left section 48 and right section 52 will extend ahead of the front apogee tangent line 62 and, thus, the frame will have a concave configuration. As illustrated, both the left portion of front edge 54 and the right portion of front edge 54 extend an angle $\gamma$ from the front apogee tangent line 62; however, it is with in the scope of the invention for the two sections to be different angles. The angle $\gamma$ can be from 10 degrees and 60 degrees, can be from 20 degrees to 40 degrees or can be from 22 degrees to 30 degrees.

Figure 3:
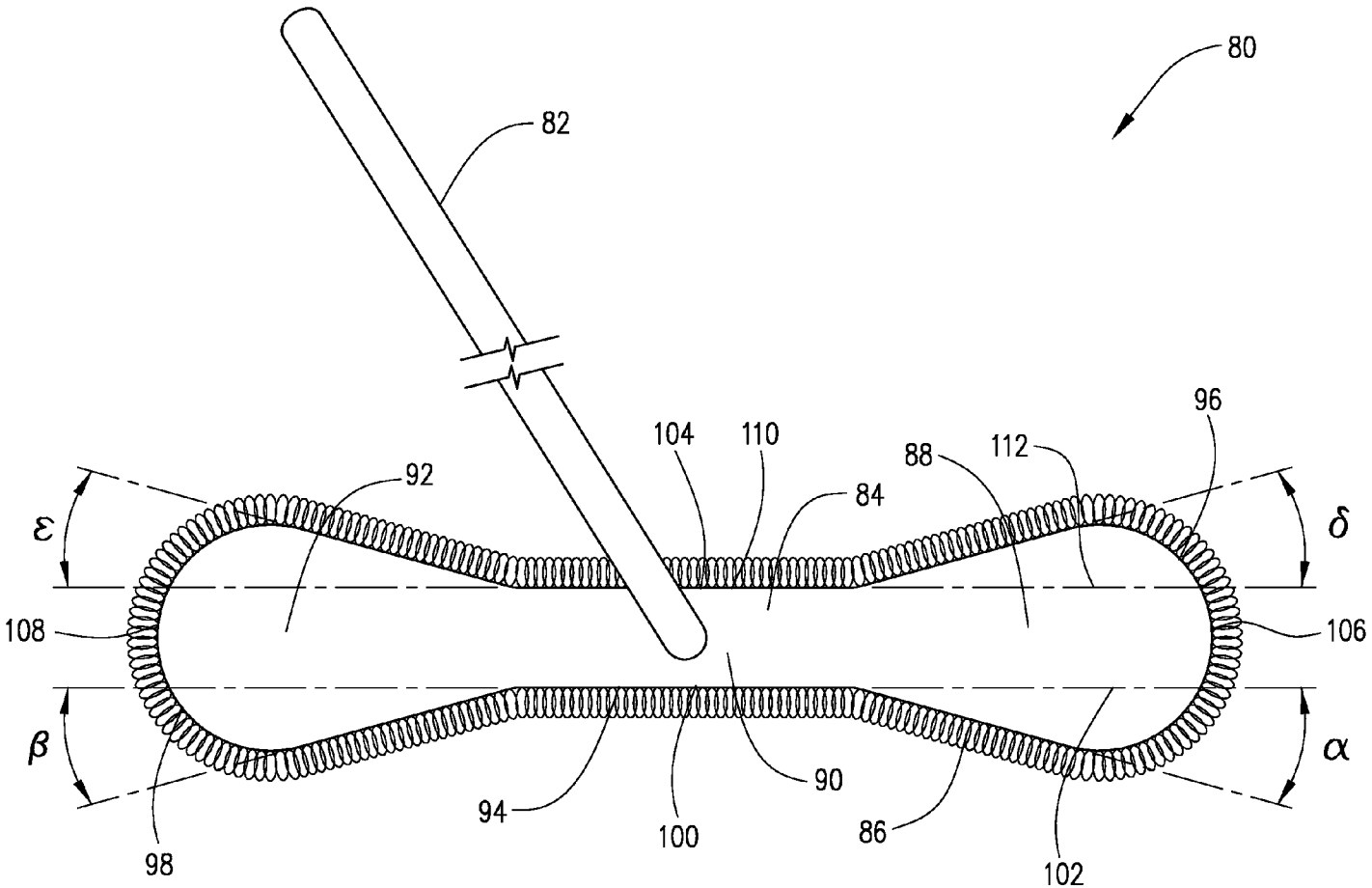
FIG. 3 is a top view of a dust mop in accordance with another embodiment of the current invention.

A house broom (also called a straight broom) or a dust mop (also called a dry mop) can utilize this same angled or curved design in both directions allowing the broom to be used in forward or backward sweeping motions. The center section remains the same but the angle/curved ends protrude in forward and backward directions, joining at the ends to form a loop. This can create a hollow center or remain solid. Referring now to FIG. 3, a dust mop 80 utilizing the design in both directions can be seen. Dust mop 80 comprises handle 82, head or head frame 84 and dry mop pad 86. Handle 82 is connected to the head frame 84. The connection can be by any conventional known means, such as by screw mounting or by the handle being formed integrally with the head frame. The dry mop pad is attached to the head frame in known conventional means for such dust mops. Typically, the pad will be a glove fitting over the frame. The head frame 84 comprises a left section 88, a center section 90 and a right section 92.

Head or head frame 84 has front edge 94 and back edge 104. Front edge 94 terminates in front left end 96 and front right end 98. Front edge 94 extends across left section 88, center section 90 and right section 92 such that a left portion of the front edge 94 extends across left section 88, a center portion of front edge 94 extends across center section 90 and a right portion of front edge 94 extends across right section 92. Front edge 94 has front apogee point 100, which can be anywhere along the center portion of front edge 94 since the center section 90 is straight. Front apogee tangent line 102 is parallel to the portion of front edge 94 at center section 90 and passes through the front apogee point 100. The end sections (left section 88 and right section 92) will be angled such that they extend ahead of the front apogee tangent line 102 and thus the frame will have a concave configuration. As illustrated, the left portion of front edge 94 is at an angle $\alpha$ to the front apogee tangent line 102 and the right portion of front edge 94 is at an angle $\beta$ to the front apogee tangent line 102. Generally, angles $\alpha$ and $\beta$ will be equal but it is within the scope of the invention for them to be different. Angles $\alpha$ and $\beta$ can be from 10 degrees and 60 degrees, can be from 20 degrees to 40 degrees or can be from 22 degrees to 30 degrees.

Back edge 104 terminates in back left end 106 and back right end 108. In the embodiment illustrated, the dust mop 80 has rounded ends thus the front left end 96 and the back left end 106 are at the same point. Also, front right end 98 and back right end 108 are at the same point. This may not be the case for other configurations. Back edge 104 extends across left section 88, center section 90 and right section 92 such that a left portion of the back edge 104 extends across left section 88, a center portion of back edge 104 extends across center section 90 and a right portion of back edge 104 extends across right section 92. Back edge 104 has back apogee point 110, which can be anywhere along the center portion of back edge 104 since the center section 90 is straight. Back apogee tangent line 112 is parallel to the portion of back edge 104 at center section 90 and passes through the back apogee point 110. The end sections (left section 88 and right section 92) will be angled such that they extend behind the back apogee tangent line 112 and, thus, the frame will have a concave configuration. As illustrated, the left portion of back edge 104 is at an angle $\delta$ from the back apogee tangent line 112 and the right portion of back edge 104 is at an angle $\epsilon$ to the back apogee tangent line 112. Generally, angles $\delta$ and $\epsilon$ will be equal but it is within the scope of the invention for them to be different. Angles $\delta$ and $\epsilon$ can be from 10 degrees and 60 degrees, can be from 20 degrees to 40 degrees or can be from 22 degrees to 30 degrees.

Similar to the embodiment of FIG. 1, the length of the center section 90 can vary, as can the length of the end sections. Generally, the center section 90 will comprise from 40 percent to 60 percent of the frame length and the left section 88 and the right section 92 will each comprise from 20 percent to 30 percent of the frame length. Often the center section 90 will comprise about 50 percent of the frame length and the left section 88 and the right section 92 will each comprise about 25 percent of the frame length.

Turning now to FIG. 6 an embodiment is illustrated where a push broom 114 has an adjustable format. Push broom 114 generally comprises handle 116, head frame 118 and bristles (not shown in FIG. 6). The head frame 118 has left section 120, center section 122 and right section 124. Center section 122 is a straight center section and has a first end 126 and a second end 128. Center section 122 has a center line 127 as shown, which is an apogee tangent line taken at the center of the frame. Left section 120 has a left end 119, which is the left end of the head frame 118, and a right end 121. Right end 121 of left section 120 is mounted to first end 126 of center section 122 so as to be rotationally adjustable. Similarly, right section 124 has a right end 123, which is the right end of head frame 118, and a left end 125. Left end 125 of right section 124 is mounted to second end 128 of center section 122 so as to be rotationally adjustable. As illustrated left section 120 and right section 124 are mounted onto center section 122 by tension screws 130 and 132, respectively. Left section 120 and right section 124 can be rotationally adjusted from an angle of 60 degrees in front of the center section to an angle 60 degrees behind the center section. Optionally, left section 120 and right section 124 can be rotationally adjusted from an angle of 40 degrees in front of the center section to an angle 40 degrees behind the center section. In other words the center line 129 of the left section 120 will be at an angle $\alpha$ to center line 127 of the center section and the center line 131 of the right section 124 is at an angle $\beta$ to center line 127. The angles $\alpha$ and $\beta$ can be from 60 degrees behind the center line 127 to 60 degrees ahead of the center line 127, or can be from 40 degrees behind the center line 127 to 40 degrees ahead of the center line 127.

In the adjustable format, the operator can loosen tension screws 130 and/or 132 or similar mechanisms, such as tongue and groove design, and adjust the angle of the end sections to the desired shape. It can be used as a straight broom (as shown by the solid lines in FIG. 6), or the ends can be adjusted forward (as shown by the phantom lines in FIG. 6) or backwards (not shown). This allows the broom to be used in both directions, to reduce bristle memory and wear.

Similar to the embodiment of FIG. 1, the length of the center section 122 can vary, as can the length of the end sections. Generally, the center section 122 will comprise from 40 percent to 60 percent of the frame length and the left section 120 and the right section 124 will each comprise from 20 percent to 30 percent of the frame length. Often the center section 122 will comprise about 50 percent of the frame length and the left section 120 and the right section 124 will each comprise about 25 percent of the frame length.

Figure 4:
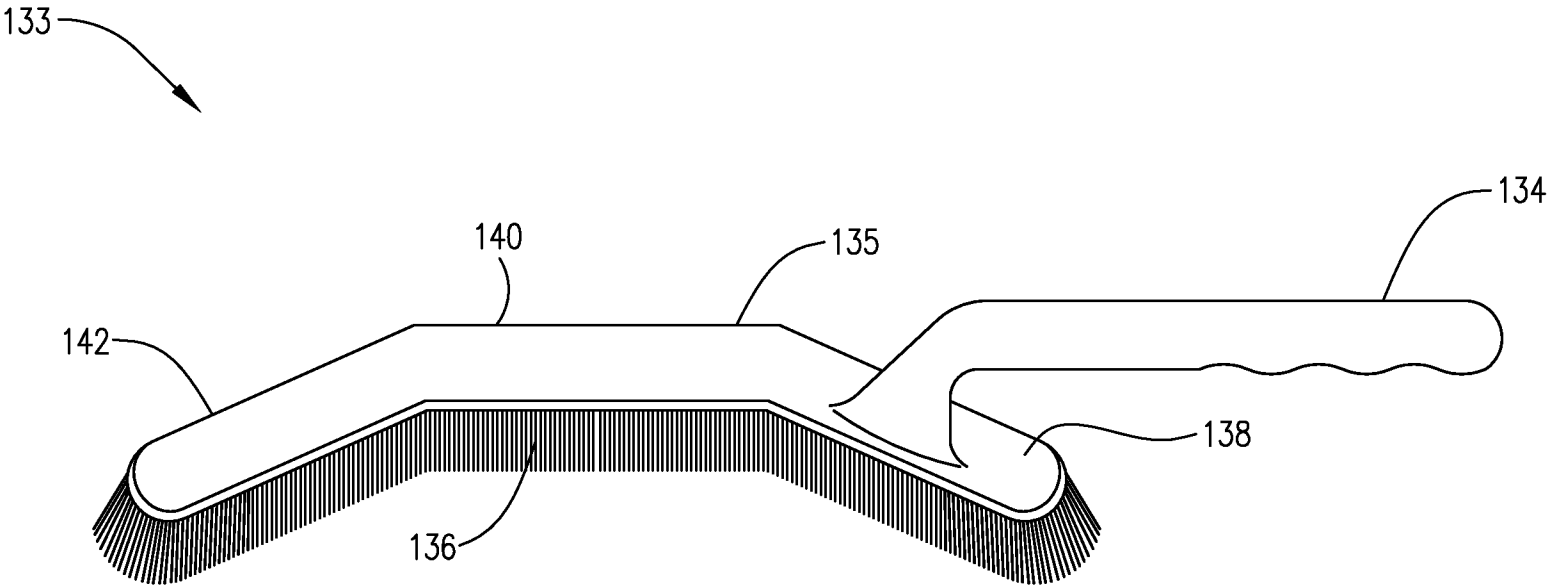
FIG. 4 is a front view of a tabletop brush or whiskbroom in accordance with yet another embodiment of the current invention.
Figure 5:
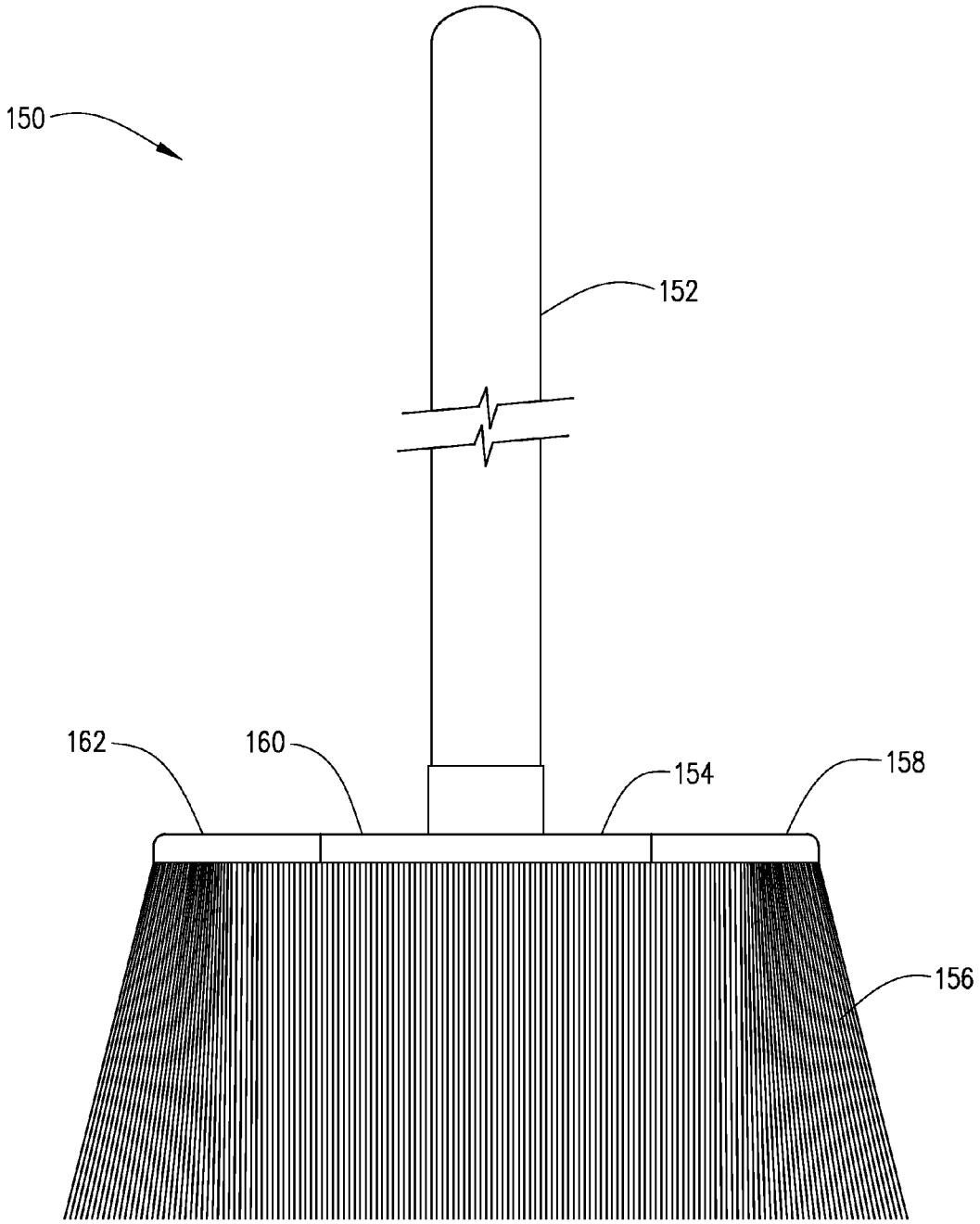
FIG. 5 is a front view of a house broom or straight broom in accordance with still another embodiment of the current invention.
Figure 3:
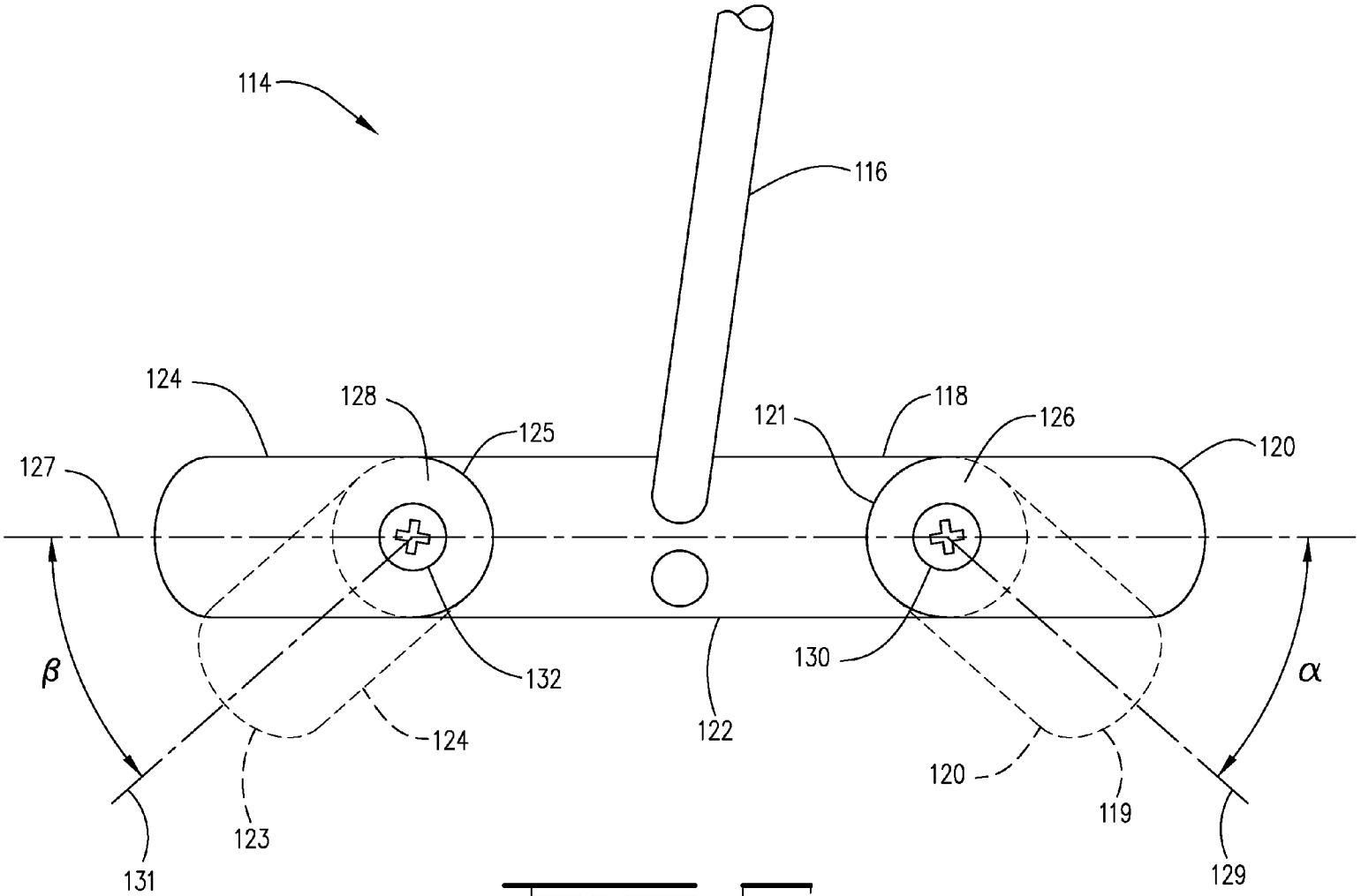

Other embodiments are illustrated in FIGS. 4 and 5. FIG. 4 illustrates a table top brush 133 (also known as a dust broom or whisk broom). Brush 133 has a handle 134, a head frame 135 and bristles 136. Head frame 135 has left section 138, center section 140 and right section 142 wherein left section 138 and right section 142 are angled as described above. FIG. 5 illustrates a house broom 150 (also known as a straight broom). Similar to the other embodiments, house broom 150 has a handle 152, a head frame 154 and bristles 156. Head frame 154 has left section 158, center section 160 and right section 162 wherein left section 158 and right section 162 are angled as described for the other embodiments.

For the various embodiments of the current invention, the broom head can be of any suitable material (plastic, metal, wood composites, etc.) and the bristles can be of numerous materials (plastics, straw, wire, wool, yarn, etc.) and in various sizes and lengths. The bristles can be of various firmness, depending on the target material to be swept. The broom handle can be of wood, plastic or metal, and can be solid or hollow. Additionally, the bristles are positioned downward on the center section, and can be directed slightly inward on the end sections to help facilitate the debris being directed towards the center of the broom head. The bristles can be flared outward on each end tip to facilitate entry into confined spaces.

While the entire head sweeps the floor, the angled or curved ends also gather and direct the dirt and debris toward the straight center area of the head. This helps collect and control the debris during sweeping and minimizes loss of material to the sides. It also makes it easier to collect into a receptacle for disposal. This broom can be in the style of a push broom, a house broom, a whisk broom, dust mop or counter top brush.

It will be seen therefore, that the present invention is well adapted to carry out the ends and advantages mentioned, as well as those inherent therein. While the presently preferred embodiments of the apparatus has been shown for the purposes of this disclosure, numerous changes in the arrangement and construction of parts may be made by those skilled in the art. All of such changes are encompassed within the scope and spirit of the appended claims.

What is claimed is:

1. A broom comprising:

a broom head frame having a front edge terminating in a front left end and a front right end, said frame having a left section, a right section and a center section with left portion of the front edge forming a part of said left section, a center portion of the front edge forming a part of the center section and a right portion of the front edge forming a part of the right section; said front edge having a front apogee point between said front left end and said front right end, and a front apogee tangent line; said front edge having a concave shape such that said left portion and said right portion each extend ahead of said front apogee tangent line by 20 degrees to 40 degrees and the length from said front left end to said front right end defining a frame length; said center section extends along said front apogee tangent line and comprising from 40 percent to 60 percent of said frame length, said left section comprising from 20 percent to 30 percent of said frame length and said right section comprising from 20 percent to 30 percent of said frame length, a broom handle, the handle having a substantial verticality extending from the broom head frame.

2. The broom of claim 1 wherein said left portion and said right portion each extend ahead of said front apogee tangent line by from 22 degrees to 30 degrees.

3. The broom of claim 1 wherein said center section is about 50 percent of said frame length, said left section is about 25 percent of said frame length and said right section is about 25 percent of said frame length.

4. The broom of claim 1 wherein said left section and said right section are integrally connected to said center section.

5. The broom of claim 1 wherein said frame further has a back edge terminating in a back left end and a back right end, wherein a left portion of the back edge forms a part of said left section, a center portion of the back edge forms a part of the center section and a right portion of the back edge forms a part of the right section; said back edge having a back apogee point between said back left end and said back right end, and a back apogee tangent line; said back edge having a concave shape such that said left portion of said back edge and said right portion of said back edge each extend behind said back apogee tangent line by from 10 degrees to 60 degrees.

6. The broom of claim 5 further comprising a dust mop head attached to said frame.

7. The broom of claim 5 wherein said frame further comprises a bottom surface having bristles mounted therein.

8. The broom of claim 1 wherein said frame is in the shape of a concave curve.

9. The broom of claim 1 further comprising a dust mop head attached to said frame.

10. The broom of claim 1 wherein said frame further comprises a bottom surface having bristles mounted therein.

* * * * *